US007236719B2

(12) United States Patent
Ishii

(10) Patent No.: US 7,236,719 B2
(45) Date of Patent: Jun. 26, 2007

(54) CHARGER FRAME, PHOTOSENSITIVE MEMBER CARTRIDGE, AND IMAGE FORMING APPARATUS

(75) Inventor: Makoto Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 124 days.

(21) Appl. No.: 10/910,326

(22) Filed: Aug. 4, 2004

(65) Prior Publication Data

US 2005/0031373 A1 Feb. 10, 2005

(30) Foreign Application Priority Data

Aug. 6, 2003 (JP) ..... 2003-288154
Aug. 6, 2003 (JP) ..... 2003-288155

(51) Int. Cl.
*G03G 21/16* (2006.01)

(52) U.S. Cl. ..... 399/111; 399/115

(58) Field of Classification Search ..... 399/107, 399/111, 113, 168, 170, 171, 172, 173, 115
See application file for complete search history.

(56) References Cited

U.S. PATENT DOCUMENTS 4,551,784 A 11/1985 DiNatale et al.
4,575,221 A 3/1986 Onoda et al.
4,708,455 A * 11/1987 Kubota et al. ..... 399/111
4,754,305 A 6/1988 Fantuzzo et al.
4,803,512 A * 2/1989 Ogura et al. ..... 399/170
4,866,482 A 9/1989 Hirasawa et al.
5,216,465 A 6/1993 Arai et al.
5,258,816 A 11/1993 Haneda et al.
5,870,654 A 2/1999 Sato et al.
2001/0048825 A1 * 12/2001 Mitchell et al. ..... 399/109

FOREIGN PATENT DOCUMENTS

JP 63-226669 * 9/1988
JP A 7-140754 6/1995
JP A 11-161126 6/1999

* cited by examiner

*Primary Examiner*—Hoan Tran
(74) *Attorney, Agent, or Firm*—Oliff & Berridge, PLC

(57) ABSTRACT

A photosensitive member cartridge includes a charger that includes a wire that generates a corona discharge, and a first fixing portion that secures at least one end of the wire in a longitudinal direction of the wire, wherein the first fixing portion includes a first positioning member that positions the wire in a first direction perpendicular to the longitudinal direction of the wire, and a second positioning member that positions the wire in the longitudinal direction of the wire and in a second direction perpendicular to the first direction.

32 Claims, 10 Drawing Sheets

CHARGER FRAME, PHOTOSENSITIVE MEMBER CARTRIDGE, AND IMAGE FORMING APPARATUS

BACKGROUND OF THE INVENTION

1. Field of Invention

The invention relates to a frame of a charger, a photosensitive member cartridge provided with the frame, and an image forming apparatus provided with the photosensitive member.

2. Description of Related Art

A known image forming apparatus, such as a laser printer, sets therein a process cartridge including a photosensitive drum and a charger having a wire that generates a corona discharge. In the process cartridge, the wire of the charger is positioned by engaging the wire in a substantially V-shaped slit formed in a positioning plate, as disclosed in for example, Japanese Laid-Open Patent Publication No. 7-140754. To form such a positioning plate with the slit, a high degree of accuracy is required for a mold that is used to create the positioning plate. Further, to make the width of the slit narrow, a mold of the positioning plate with a narrow slit is susceptible to damage. When the charger is assembled, positioning of the wire accurately using a single positioning plate is complicated or troublesome.

The process cartridge is provided with a cleaning device that removes paper powders attached to a surface of the photosensitive drum. As disclosed in, for example, Japanese Laid-Open Patent Publication No. 11-161126, the cleaning device is integrally formed with a corona charger, as a cleaning unit. The cleaning unit, as a whole, is detached from the process cartridge.

As the cleaning device is united into a single cleaning unit, the cleaning device may not uniformly contact the photosensitive drum, according to a setting accuracy of the cleaning unit, leading to poor paper powder removing performance. If the position of the cleaning device relative to the photosensitive drum is deviated every time the cleaning device is set in the process cartridge, paper powders attached to the photosensitive drum are not sufficiently removed.

SUMMARY OF THE INVENTION

Accordingly, one exemplary aspect of the invention is to provide a frame of charger that is readily and accurately formed, as well as readily assembled. A photosensitive member cartridge provided with the frame of the charger, and an image forming apparatus provided with the photosensitive member cartridge is also provided. Another exemplary aspect of the invention is to provide a photosensitive member cartridge that includes a foreign material removing member, as a unit, with a sufficient and a stable foreign material removing performance, as well as to provide an image forming apparatus including such a photosensitive member cartridge.

The invention thus includes, according to an exemplary aspect of the invention, a charger that includes a wire that generates a corona discharge, a charger frame that supports the wire, and a first fixing portion that secures at least one end of the wire in a longitudinal direction of the wire, the first fixing portion being disposed in the frame, wherein the first fixing portion includes a first positioning member that positions the wire in a first direction perpendicular to the longitudinal direction of the wire, and a second positioning member that positions the wire in the longitudinal direction of the wire and in a second direction perpendicular to the first direction.

The invention also includes, according to another exemplary aspect of the invention, a photosensitive member cartridge that includes a charger that includes a wire that generates a corona discharge, a photosensitive member, a frame that supports the charger and the photosensitive member, and a first fixing portion that secures at least one end of the wire in a longitudinal direction of the wire, the first fixing portion being disposed in the frame, wherein the first fixing portion includes a first positioning member that positions the wire in a first direction perpendicular to the longitudinal direction of the wire, and a second positioning member that positions the wire in the longitudinal direction of the wire and in a second direction perpendicular to the first direction.

The invention also includes, according to another exemplary aspect of the invention, an image forming apparatus that includes a photosensitive member cartridge that is removably set in the image forming apparatus, wherein the photosensitive member cartridge includes a charger that includes a wire that generates a corona discharge, a photosensitive member, a frame that supports the charger and the photosensitive member, and a first fixing portion that secures at least one end of the wire in a longitudinal direction of the wire, the first fixing portion being disposed in the frame, wherein the first fixing portion includes a first positioning member that positions the wire in a first direction perpendicular to the longitudinal direction of the wire, and a second positioning member that positions the wire in the longitudinal direction of the wire and in a second direction perpendicular to the first direction.

The invention also includes, according to another exemplary aspect of the invention, a photosensitive member cartridge that includes a photosensitive member, a photosensitive member frame that supports the photosensitive member, a foreign material removing member that removes foreign material on the photosensitive member, a foreign material removing unit that supports the foreign material removing member, and an urging member that urges the foreign material removing unit toward the photosensitive member.

The invention also includes, according to another exemplary aspect of the invention, an image forming apparatus that includes a photosensitive member cartridge that removably sets in the image forming apparatus, wherein the photosensitive member cartridge includes a photosensitive member, a photosensitive member frame that supports the photosensitive member, a foreign material removing member that removes foreign material on the photosensitive member, a foreign material removing unit that supports the foreign material removing member, and an urging member that urges the foreign material removing unit toward the photosensitive member.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
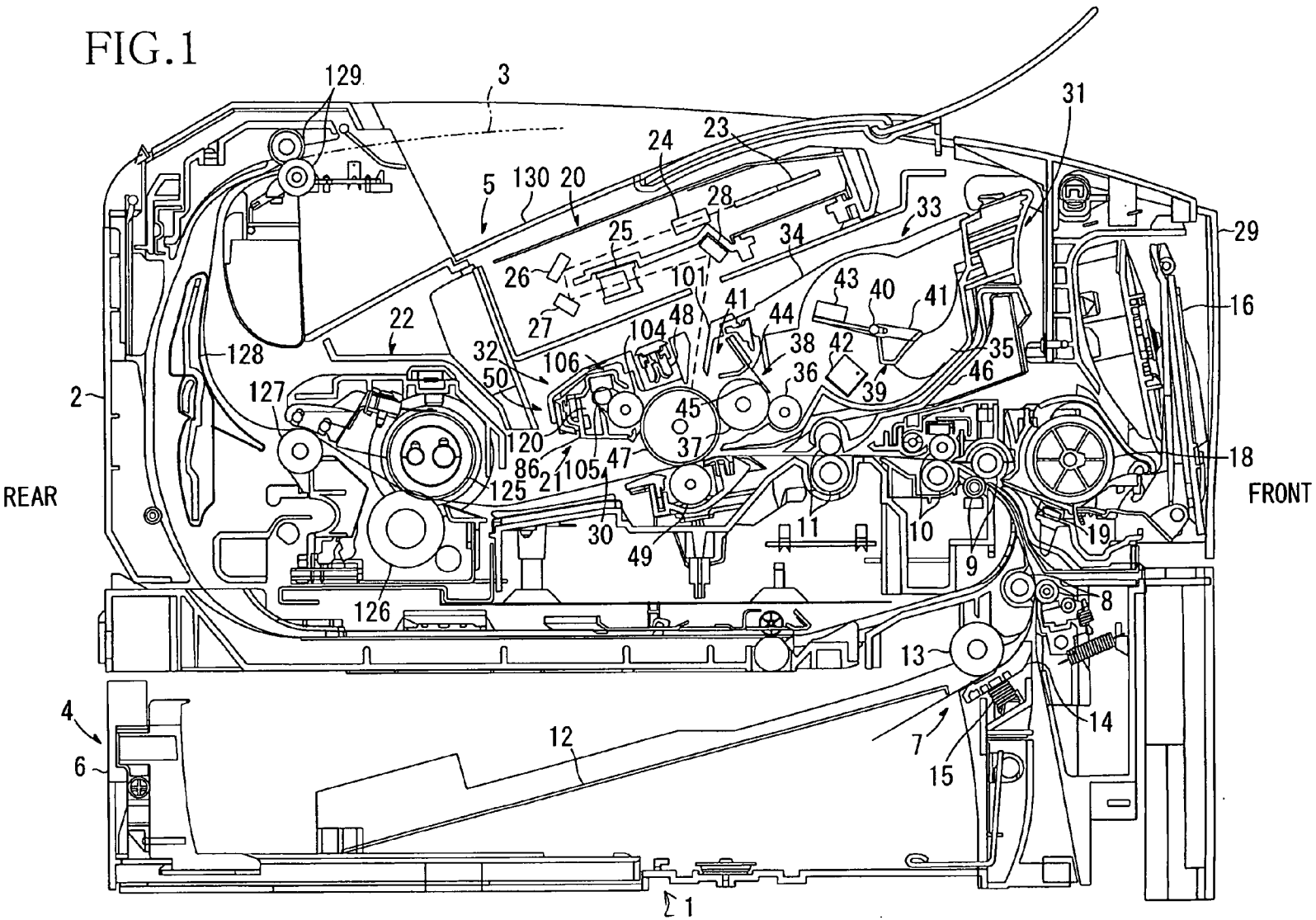
FIG. 1 is a side sectional view showing an essential portion of a laser printer as an image forming apparatus according to an embodiment of the invention.

FIG. 1 is a side sectional view showing an essential portion of a laser printer 1 as an image forming apparatus according to an embodiment of the invention.

In FIG. 1, the laser printer 1 is an electrophotographic laser printer that forms an image in a non-magnetic single-component development system. The laser printer 1 is provided in a main frame 2 with a feeder section 4 for feeding sheets 3 and an image forming section 5 for forming images on the fed sheets 3.

The feeder section 4 includes a sheet supply tray 6 removably set on a bottom of the main frame 2, a sheet supply mechanism portion 7 disposed at one side (front side) of the sheet supply tray 6 (hereinafter an opposite side to the front side is referred to as the rear side), conveying rollers 8, 9, 10 disposed downstream of the sheet supply mechanism portion 7 in a sheet feeding direction, and register rollers 11 disposed downstream of the conveying rollers 8, 9, 10 in the sheet feeding direction.

The sheet supply tray 6 is of a box shape with an upper open construction so as to accommodate therein a stack of sheets 3. The sheet supply tray 6 is slidable substantially horizontally to the bottom of the main frame 2. A sheet mount plate 12 is provided in the sheet supply tray 6 so as to allow the sheets 3 to be stacked on the sheet mount plate 12. The sheet mount plate 12 is pivotally supported on one end far from the sheet supply mechanism portion 7, so that the other end of the sheet mount plate 12 near the sheet supply mechanism portion 7 is movable in a vertically direction. Disposed on the underside of the sheet mount plate 12 is a spring (not shown) that urges the sheet mount plate 12 upwardly. As the amount of the sheets 3 stacked on the sheet mount plate 12 increases, the sheet mount plate 12 pivots downward about the one end far from the sheet supply mechanism portion 7, against an urging force of the spring.

The sheet supply mechanism portion 7 includes a pick-up roller 13, a separation pad 14 disposed so as to face the pick-up roller 13, and a spring 15 disposed on an underside of the separation pad 14. In the sheet supply mechanism portion 7, the separation pad 14 is pressed against the pick-up roller 13 by an urging force of the spring 15.

An uppermost sheet 3 on the sheet mount plate 12 is pressed toward the pick-up roller 13 as the sheet mount plate 12 is urged upwardly by the spring. By the rotation of the pick-up roller 13, a leading end portion of the uppermost sheet 3 is nipped between the pick-up roller 13 and the separation pad 14. The sheets 3 are separated one by one in cooperation with the pick-up roller 13 and the separation pad 14. The separated sheet 3 is delivered to the register rollers 11 by the conveying rollers 8, 9, 10.

The register rollers 11 include a pair of rollers. The register rollers 11 correct the skew of the sheets 3, and then feed the sheets 3 to an image forming position where a photosensitive drum 47 and a transfer roller 49 (described below) contact each other.

The feeder section 4 of the laser printer 1 further includes a multi-purpose tray 16 on which sheets 3 of any size are mountable, a multi-purpose pick-up roller 18 that feeds the sheets 3 mounted on the multi-purpose tray 16, and a multi-purpose separation pad 19 disposed so as to face the multi-purpose pick-up roller 18. The multi-purpose tray 16 is accommodated in a folded manner inside a front cover 29 (described below) when not in use.

The image forming section 5 includes a scanner unit 20, a process unit 21, and a fixing unit 22. The scanner unit 20 is provided in an upper portion of the main frame 2. The scanner unit 20 includes a laser emitting portion (not shown), a polygon mirror 23 that is driven so as to spin, lenses 24, 25, and reflecting mirrors 26, 27, 28. A laser beam modulated based on image data is emitted from the laser emitting portion. The laser beam emitted from the laser emitting portion passes through or reflects off the polygon mirror 23, the lens 24, the reflecting mirrors 26, 27, the lens 25, and the reflecting mirror 28 in this order, as indicated by broken lines in FIG. 1, to irradiate with the laser beam a surface of the photosensitive drum 47 (described in detail below) of the process unit 21.

The process unit 21 is disposed below the scanner unit 20. The process unit 21 is removably set into the main frame 2. More specifically, the main frame 2 includes a main accommodating portion 30 for accommodating the process unit 21, an opening 31 leading to the main accommodating portion 30 for removably setting the process unit 21 in the main frame 2, and the front cover 29 for covering or uncovering the opening 31. The main accommodating portion 30 is provided as a space below the scanner unit 20. The opening 31 is formed at a front side of the main accommodating portion 30.

The front cover 29 is provided so as to extend from a front face of the main frame 2 to an upper face of the main frame 2. The front cover 29 pivots between an open position where the front cover 29 uncovers the opening 31 and a closed position where the front cover 29 covers the opening 31. With the front cover 29 in the open position, the process unit 21 is removably set into the main accommodating portion 30, through the opening 31.

The process unit 21 includes a photosensitive member cartridge 32 detachably mounted on the main frame 2 and a developing cartridge 33 detachably set in the photosensitive member cartridge 32.

The developing cartridge 33 includes a case 34, and a toner hopper 35. A supply roller 36, a developing roller 37, and a layer thickness regulating blade 38 are disposed in the case 34.

The toner hopper 35 accommodates, as a developing agent, positively chargeable non-magnetic single component toner. The toner is, for example, polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1–C4) acrylate, and alkyl (C1–C4) methacrylate. Polymerized toner particles are spherical in shape, having excellent fluidity. Toner particle sizes are approximately 6 to 10 μm. The toner is mixed with a coloring material, such as carbon black, and wax, as well as an external additive, such as silica, to improve the fluidity of the toner.

An agitator 39 is disposed in the toner hopper 35 along the width direction of the case 34. The agitator 39 includes a rotating shaft 40 rotatably supported at a central portion of the toner hopper 35, and an agitating wing 41 provided on the rotating shaft 40. A film is attached to a free end of the agitating wing 41. As the rotating shaft 40 rotates, the agitating wing 41 moves in a circumferential direction of the rotating shaft 40. Accordingly, the toner in the toner hopper 35 is scooped up by the film and is conveyed to the supply roller 36. Disposed on an opposite side of the agitating wing 41 with respect to the rotating shaft 40 is a wiper 43 that wipes off a residual toner amount detecting window 42 provided on a side wall of the case 34.

The supply roller 36 is disposed on a rear portion of the toner hopper 35, along the width direction of the case 34. The supply roller 36 is rotatably supported at each end of the case 34 in the width direction thereof. The supply roller 36 is rotatable in a direction opposite to a rotating direction of the agitator 39. The supply roller 36 includes a metal roller shaft covered by a roller portion formed of conductive urethane sponge.

The developing roller 37 is disposed behind the supply roller 36, along the width direction of the case 34. The developing roller 37 is rotatably supported at each end of the case 34 in the width direction thereof. The developing roller 37 is rotatable in the same direction as the supply roller 36.

The developing roller 37 includes a metal roller shaft covered by a roller portion formed of a conductive elastic material. More specifically, the roller portion of the developing roller 37 is formed of conductive urethane rubber or silicone rubber including fine carbon particles. A surface of the roller portion of the developing roller 37 is coated with urethane rubber or silicone rubber including fluorine. A power supply (not shown) is connected to the roller shaft of the developing roller 37, to apply a development bias during development.

The, supply roller 36 and the developing roller 37 are disposed so as to face each other. The supply roller 36 and the developing roller 37 contact each other such that the supply roller 36 applies some pressures to the developing roller 37. At a contact portion where the supply roller 36 and the developing roller 37 contact each other, the supply roller 36 and the developing roller 37 rotate or move in directions opposite from each other.

The layer thickness regulating blade 38 is disposed above the supply roller 36 between positions where the developing roller 37 faces the supply roller 36 and the photosensitive drum 28 in the rotating direction of the developing roller 37. The regulating blade 38 is disposed to face the developing roller 37 along an axial direction of the developing roller 37 across the width of the case 34.

The regulating blade 38 includes a flat spring member 44, and a pressing portion 45 attached to one end of the flat spring member 44 so as to contact the developing roller 37 and formed of insulating silicone rubber. With the flat spring member 44 being supported by the case 34, the pressing portion 45 presses the surface of the developing roller 37 with the elasticity of the flat spring member 44.

The toner in the toner hopper 35 is scooped up by the rotation of the agitator 39 and is conveyed to the supply roller 36. The toner conveyed to the supply roller 36 is supplied to the developing roller 37 by the rotation of the supply roller 36. When the toner is supplied from the supply roller 36 to the developing roller 37, the toner is positively charged by the friction between the supply roller 36 and the developing roller 37.

The charged toner is carried onto the surface of the developing roller 37, and enters between the developing roller 37 and the pressing portion 45 of the regulating blade 38, as the developing roller 37 rotates. At the time when the toner enters between the developing roller 37 and the pressing portion 45, the toner is further frictionally charged and carried on the surface of the developing roller 37 as a thin layer whose thickness has been regulated.

The photosensitive member cartridge 32 includes a photosensitive member frame 46, as a frame, a photosensitive drum 47, as a photosensitive member, a scorotron charger 48, a transfer roller 49, and a cleaning unit 50, as a foreign material removing unit.

Figure 2:
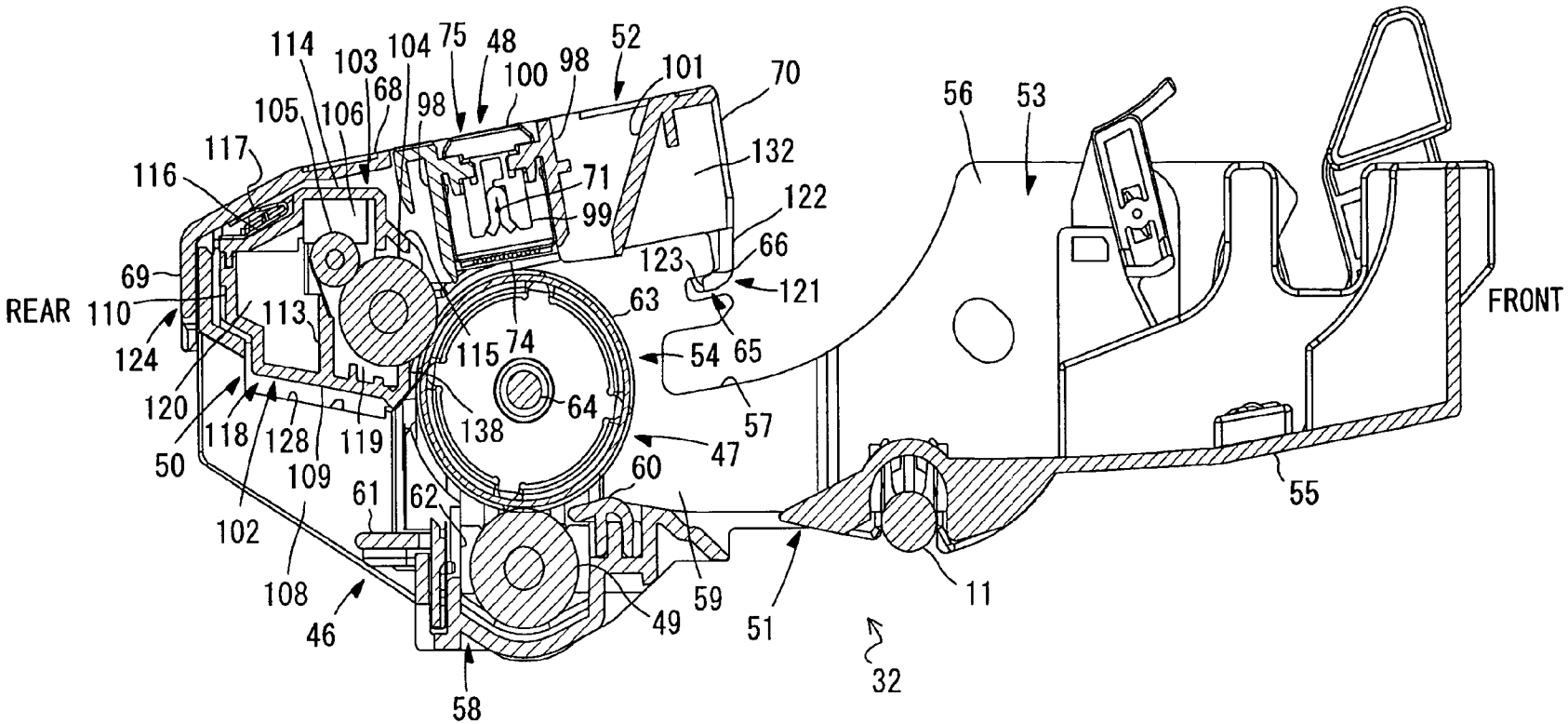
FIG. 2 is a side sectional view of a photosensitive member cartridge of the laser printer shown in FIG. 1.

The photosensitive member frame 46 includes a lower frame 51, and an upper frame 52, as a charger frame, that is disposed above the lower frame 51 and attached to the lower frame 51, as shown in FIG. 2.

The lower frame 51 is integrally provided with a process accommodating portion 53 that accommodates the developing cartridge 33 and a drum accommodating portion 54 that accommodates the photosensitive drum 47 and the transfer roller 49.

The process accommodating portion 53 is integrally provided with a bottom plate 55 that receives the developing cartridge 33, a side plate 56 that extends upwardly from each end of the bottom plate 55 in the width direction thereof perpendicular to the frontward and rearward direction. The process accommodating portion 53 is of substantially U shape and open upwardly. One of the register rollers 11 (disposed on an upper side) is rotatably supported on an underside of the bottom plate 55.

Each side plate 56 has a developing cartridge guiding groove 57 that receives the roller shaft of the developing roller 37 protruding outwardly in the width direction of the case 34, from the case 34 of the developing cartridge 33.

The developing cartridge guiding groove 57 has a wider opening at an upper end thereof and extends rearward to form a substantially U-shape. The roller shaft of the developing roller 37 is received and guided by the developing cartridge guiding grooves 57 and positioned in the rearmost portion of the developing cartridge guiding groove 57. Thus, the developing cartridge 33 is accommodated in the process accommodating portion 53 in which the developing roller 37 and the photosensitive drum 47 contact each other.

The drum accommodating portion 54 is integrally provided with a transfer roller receiver 58 that receives the transfer roller 49 and a side plate 59 that extends upwardly from each end of the transfer roller receiver 58 in the width direction thereof perpendicular to the frontward and rearward direction. The drum accommodating portion 54 is of substantially U shape and open upwardly. The side plates 56 of the process accommodating portion 53 are continuously and integrally formed with the relevant side plates 59 of the drum accommodating portion 54.

The transfer roller receiver 58 includes front and rear guide plates 60, 61 of flat plates extending in the frontward and rearward direction, and a transfer roller accommodating portion 62 that is formed into a recess curving downwardly between the front and rear guide plates 60, 61. The front guide plate 60 and the rear guide plate 61 guide the sheet 3 in the neighborhood of a transfer position where the toner is transferred on the sheet 3, as will be described below.

The transfer roller 49 is disposed in the transfer roller accommodating portion 62, along the width direction thereof. The transfer roller 49 is supported by the side plates 59 provided on both sides of the transfer roller accommodating portion 62, to rotate in an opposite direction to the rotating direction of the photosensitive drum 47.

The transfer roller 49 includes a metal roller shaft covered by a roller portion formed of conductive rubber. A transfer bias is applied to the roller shaft of the transfer roller 49, to transfer the toner onto the sheet 3. The photosensitive drum 47 is rotatably supported between the side plates 59. The photosensitive drum 47 is disposed above the transfer roller 49, to face the transfer roller 49.

The photosensitive drum 47 includes a cylindrical drum body 63 and a metal drum shaft 64 that supports the drum body 63 and provided on the center of an axis of the drum body 63. The drum body 63 is made of an aluminum drum and a positively chargeable photosensitive coating layer formed on a surface of the aluminum drum.

Disposed on an upper front end of each side plate 59 is a lower engagement portion 65 that engages with the upper frame 52. The lower engagement portion 65 is of substantially recessed shape that extends in the frontward and rearward direction and is open forwardly. A protrusion 66 is disposed on an upper portion of the lower engagement portion 65.

Disposed on an upper rear end of the side plates 59 on both sides of the drum accommodating portion 54 in the width direction thereof are screw fixing portions (not shown) for screwing the upper frame 52 on the lower frame 51. The upper frame 52 is integrally formed with an upper plate 68 that covers an upper portion of the drum accommodating portion 54 of the lower frame 51, a rear plate 69 that extends downwardly from a rear end of the upper plate 68, a front plate 70 that extends downwardly from a front end of the upper plate 68, and side plates 131, 132, provided on each end in the width direction of the upper plate 68, the rear plate 69, and the front plate 70, perpendicular to the frontward and rearward direction.

A pair of supporting plates 98 is disposed at the forward and rearward direction with a predetermined distance therebetween and extend along the width direction of the upper plate 68. The supporting plates 98 extend downwardly from the upper plate 68. Disposed between the supporting plates 98 is the scorotron charger 48.

With the upper frame 52 set onto the lower frame 51, the scorotron charger 48 is disposed above the photosensitive drum 47 with a predetermined distance therebetween, to prevent the scorotron charger 48 from contacting the photosensitive drum 47.

Figure 3:
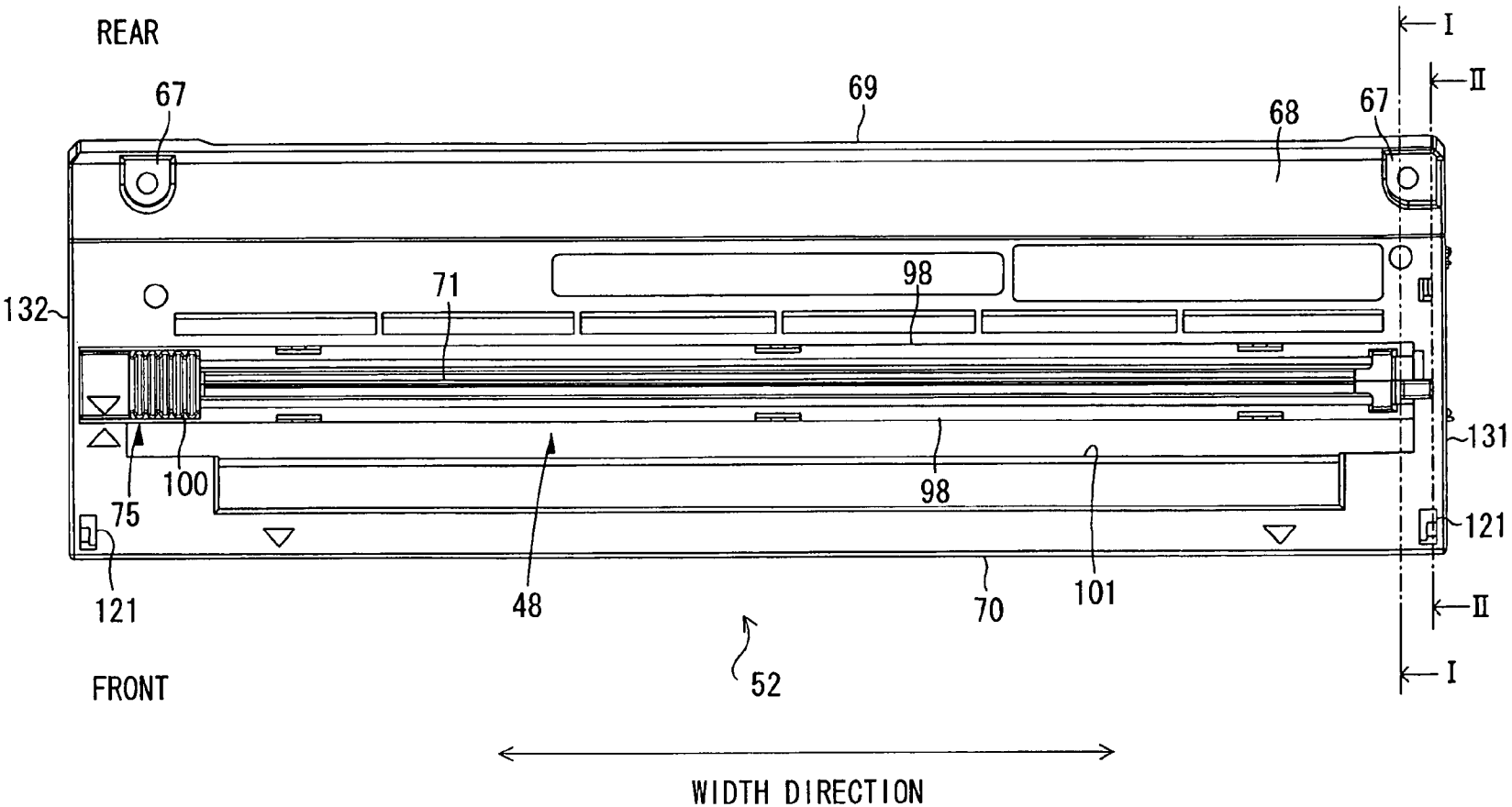
FIG. 3 is a plan view of an upper frame of the photosensitive member cartridge shown in FIG. 2.
Figure 4:
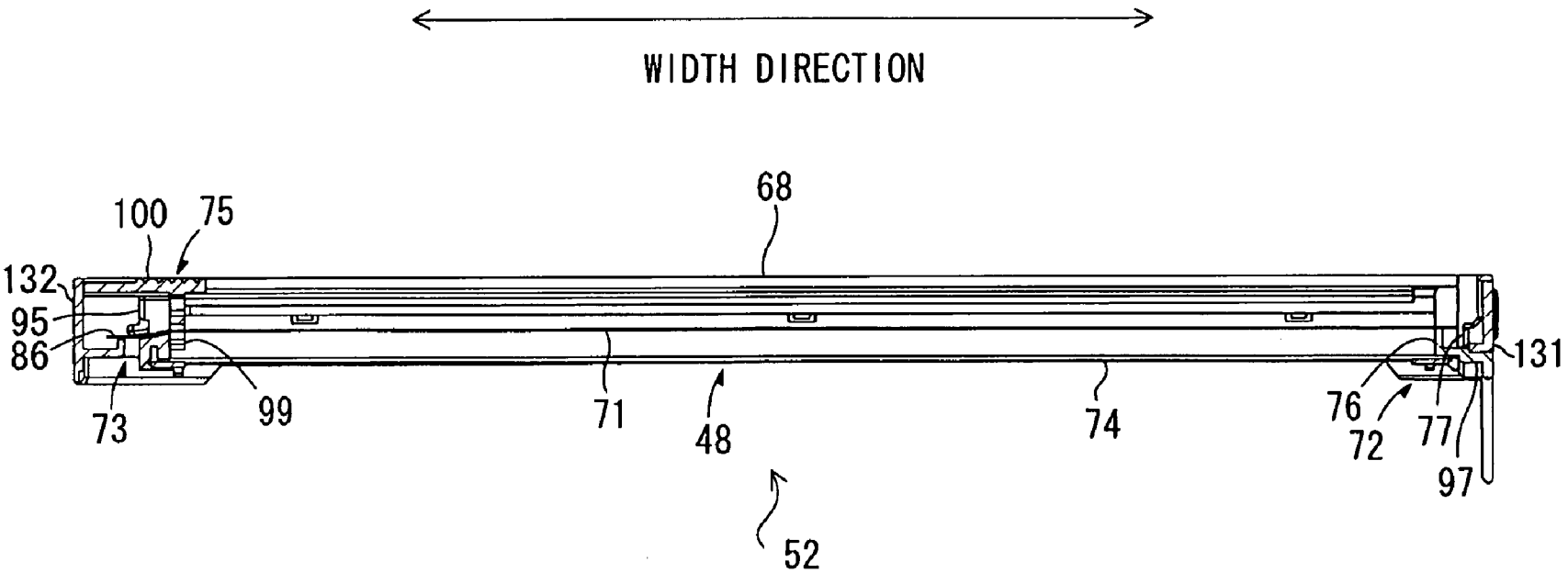
FIG. 4 is a longitudinal sectional view of the upper frame of the photosensitive member cartridge shown in FIG. 2.

The charger 48 is a positively charging scorotron charger. As shown in FIGS. 3 and 4, the scorotron charger 48 includes a wire 71 that generates a corona discharge, a first fixing portion 72 and a second fixing portion 73 that fix ends of the wire 71 in a longitudinal direction of the wire 71, a grid electrode 74 disposed below the wire 71 to face the wire 71, and a wire cleaner 75 that cleans the wire 71.

Figure 6:
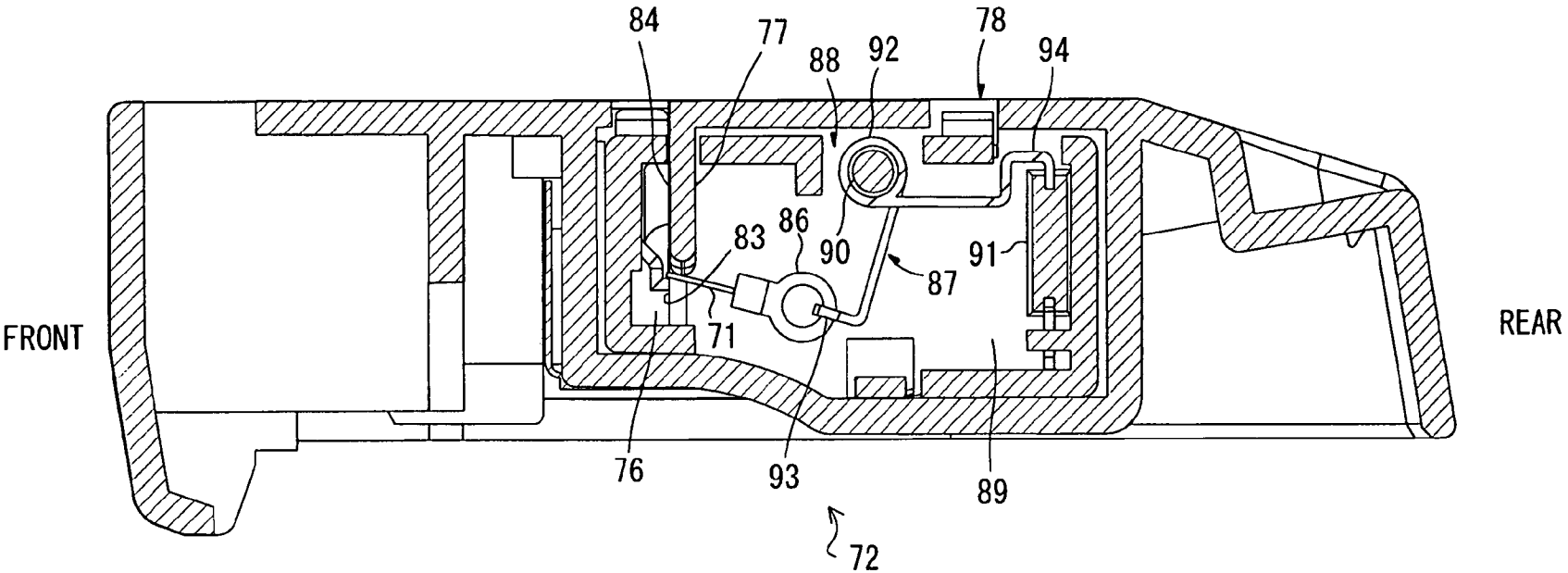
FIG. 6 is a side sectional view showing an essential portion of a second positioning member and a supporting member of the upper frame shown in FIG. 4, taken along II—II of FIG. 3.
Figure 7:
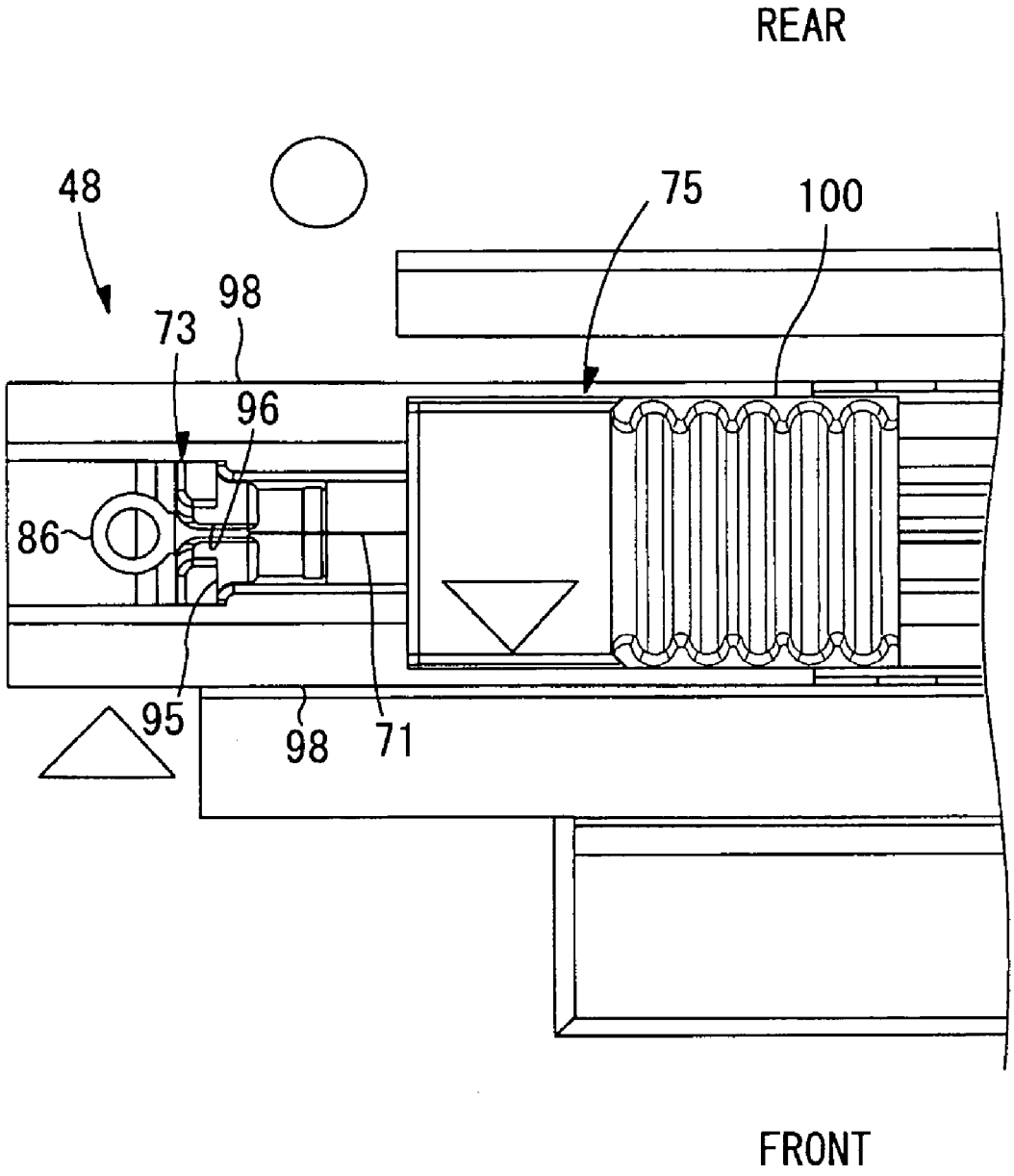
FIG. 7 is an enlarged plan view showing an essential portion of the upper frame shown in FIG. 3.

The wire 71 is a tungsten wire disposed between the supporting plates 98. The wire 71 is disposed with a predetermined distance between the wire 71 and the photosensitive drum 47. The wire 71 is also disposed between the first and second fixing portions 72, 73 along the width direction of the upper frame 52, as indicated in FIGS. 3 and 4, to face the photosensitive drum 47. As shown in FIGS. 6 and 7, a ring-shaped retainer 86 is disposed at each end of the wire 71 in the longitudinal direction thereof.

The first fixing portion 72 is disposed on one side of the upper plate 68 of the upper frame 52 in the longitudinal direction of the wire 71. The first fixing portion 72 includes a first positioning member 76 that positions the wire 71 in a vertical direction, as a first direction (direction that the scorotron charger 48 and the photosensitive drum 47 face each other) perpendicular to the longitudinal direction of the wire 71, a second positioning member 77 that positions the wire 71 in the longitudinal direction thereof and in a horizontal (forward and rearward) direction, as a second direction, perpendicular to the vertical direction, and a supporting member 78 that supports one end of the wire 71.

As shown in FIG. 4, disposed at a lower end of the side plate 131 of the upper frame 52 is a first fixing portion supporting member 97 that extends inwardly in the width direction of the upper frame 52. The first positioning member 76 is disposed inwardly from the second positioning member 77 in the width direction of the upper frame 52 at a position parallel to the longitudinal direction of the wire 71. The first positioning member 76 is held upright at the first fixing portion supporting member 97 with a predetermined distance between the first positioning member 76 and the second positioning member 77. The second positioning member 77 is disposed outwardly from the first positioning member 76 in the width direction of the upper frame 52, so as to extend downwardly from the upper plate 68. With the structure, the second positioning member 77 is disposed closer to the end of the wire 71 in the longitudinal direction thereof than the first positioning member 76.

Figure 5:
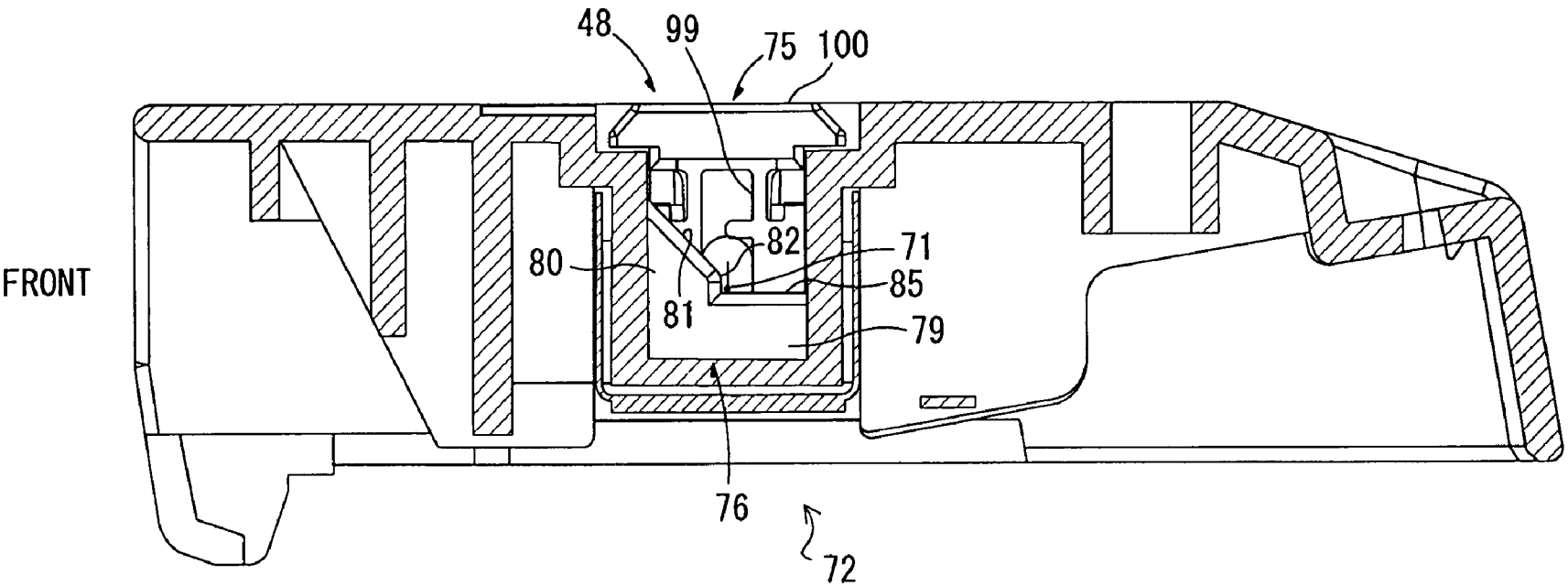
FIG. 5 is a side sectional view showing an essential portion of a first positioning member of the upper frame shown in FIG. 4, taken along I—I of FIG. 3.

As shown in FIG. 5, the first positioning member 76 is of substantially "L" shape in side view. The first poisoning member 76 is integrally formed with a first contact portion 79 where the wire 71 is positioned while contacting the first contact portion 79, and a first guide portion 80 that guides the wire 71 to the first contact portion 79.

The first contact portion 79 is of a substantially rectangular plate shape. Formed on an upper end of the first contact portion 79 is a first contact surface 85 that positions the wire 71 in the vertical direction when the wire 71 contacts the first contact surface 85. The first contact surface 85 extends levelly in the forward and rearward direction (in the horizontal direction), to prevent the wire 71 from moving in the vertical direction. The first contact surface 85 is chamfered to improve the accuracy of positioning the wire 71.

The first guide portion 80 is of a substantially triangular plate shape. Formed on a rear end of the first guide portion 80 is a restriction surface 82 that is connected to a front end of the first contact surface 85. A first guide surface 81 is formed to connect an upper end of the restriction surface 82.

The restriction surface 82 is a stepped portion formed between the first contact surface 85 and the first guide surface 81. The restriction surface 82 stands upright at the front end of the first contact surface 85. The restriction surface 82 is a flat surface extending in the vertical direction. The restriction surface 82 is chamfered to improve the accuracy of positioning the wire 71.

The first guide surface 81 is a flat surface extending forwardly in an upward slanting direction from an upper end of the restriction surface 82. The first guide surface 81 is chamfered to smoothly guide the wire 71.

As shown in FIGS. 4 and 6, the second positioning member 77 is a flat plate extending in the width direction of the upper frame 52 and downwardly from the upper plate 68. The second positioning member 77 is integrally formed with a second contact surface 83, as a second contact portion, where the wire 71 is the positioned wire 71 while contacting the second contact surface 83, and a second guide surface 84, as a second guide portion, that guides the wire 71 to the second contact surface 83.

The second contact surface 83 is formed as a lower edge of the second positioning member 77. The second contact surface 83 is rounded to prevent the wire 71 that contacts the contact surface 83 from being moved in the forward or rearward direction. The second guide surface 84 is formed as a front face of the second positioning member 77 into a flat surface connected to the second contact surface 83.

The supporting member 78 is disposed on a rear side of the second positioning member 77. The supporting member 78 includes an elastic engagement member 87 that is made of a wire, and a fixing member 88 that fixes the elastic engagement member 87.

The fixing member 88 is integrally formed with a fixing plate 89 that extends downward from one side end of the upper plate 68, an engagement shaft 90 that is disposed on an upper portion of the fixing plate 89 and protrudes outwardly in the width direction of the upper frame 52, and a fixing portion 91 that is disposed on the fixing plate 89 behind the engagement shaft 90.

The elastic engagement member 87 is of substantially "L" shape. The elastic engagement member 87 is integrally formed with a ring portion 92 that is wound in a circular shape and is fitted over the engagement shaft 90, a hook 93 that is connected or hooked to the retainer 86 provided on the one end of the wire 71, and an engagement fixed portion 94 that is fixed at the fixing portion 91.

As shown in FIG. 7, the second fixing portion 73 is disposed on the upper plate 68 of the upper frame 52 on an opposite side from the first fixing portion 72 in the longitudinal direction of the wire 71. The second fixing portion 73 includes a wire engagement portion 95 that fixes the other end of the wire 71.

The wire engagement portion 95 is of a substantially rectangular plate shape. The wire engagement portion 95 is provided with a slit 96 into which the other end portion of the wire 71 inserted. The slit 96 has such a width that allows the other end of the wire 71 to pass through the slit 96. The slit 96 is formed at a substantially central portion of the wire engagement portion 95 in the frontward and rearward direction, into a recessed shape that extends downwardly from an upper edge of the wire engagement portion 95. The deepest portion of the slit 96 is substantially at the same level as the height of the first contact surface 85 of the first positioning member 76.

To fix the wire 71 at the first and second fixing portions 72, 73, the other end of the wire 71 is inserted into the slit 96 of the wire engagement portion 95 to fixedly dispose the retainer 86 provided on the other end of the wire 71 outwardly of the wire engagement portion 96 in the width direction of the upper frame 52, as shown in FIG. 7.

Thereafter, while the one end of the wire 71 contacts the first guide surface 81 of the first positioning member 76, the wire 71 is guided toward a lower slanting direction, to the first contact surface 85, through the restriction surface 82. Thus, the wire 71 is positioned in a first contact position where the wire 71 contacts the first contact surface 85. In the first contact position, the wire 71 is positioned in the vertical direction.

Then, the one end of the wire 71 placed outwardly in the width direction of the upper frame 52 from the first contact position. The one end of the wire 71 contacts with the second guide surface 84 of the second positioning member 77. While contacting with the second guide surface 84, the wire 71 is guided downward and then pulled rearward to contact the second contact surface 83. Thus, the wire 71 is positioned in the second contact position where the wire 71 contacts the second contact surface 83. In the second contact position, the wire 71 is positioned in the frontward and rearward direction (horizontal direction).

Thereafter, the retainer 86 provided at the one end of the wire 71 is hooked or connected to the hook 93 of the elastic engagement member 87. The ring portion 92 of the elastic engagement member 87 is fitted over the engagement shaft 90. The engagement fixed portion 94 is fixed at the fixing portion 91.

In the supporting member 78, the wire 71 is supported under tension at a position below the first contact position where the wire 71 contacts the first contact surface 85 (i.e., the wire 71 is pulled toward the first contact portion 79) and on a rear side of the second contact position where the wire 71 contacts the second contact surface 83 (i.e., the wire 71 is pulled toward the second contact surface 83). Thus, the wire 71 is positioned in the longitudinal direction of the wire 71.

As shown in FIG. 2, the grid electrode 74 is disposed between a pair of the supporting plates 98. The grid electrode 74 is formed of a plurality of fine wires aligned in parallel in the frontward and rearward direction with a predetermined distance between the adjacent fine wires. The grid electrode 74 is disposed between the wire 71 and the photosensitive drum 47.

As shown in FIGS. 2 and 3, the wire cleaner 75 includes a wire holding portion 99 that holds the wire 71 at the front and rear sides thereof, and a holder 100 provided above the wire holding portion 99. The holder 100 is supported by the supporting plates 98 to allow the holder 100 to slide along the longitudinal direction of the wire 71.

While the wire 71 is held by the wire holding portion 99, the holder 100 is moved from the other end side of the wire 71 (left side end in FIG. 3) to the one end side of the wire 71 (right side end in FIG. 3). Thus, the wire cleaner 75 cleans the wire 71 with the wire holding portion 99 that removes materials attached to an outer surface of the wire 71 as the holding portion 99 holding the wire 71 is moved together with the holder 100.

As shown in FIGS. 2 and 3, a light introducing opening 101 for irradiating the photosensitive drum 47 with the laser beam from the scanner unit 20, is formed in the upper plate 68 on the front side of the scorotron charger 48, to extend along the width direction of the upper plate 68.

As shown in FIG. 3, disposed on each front end of the upper plate 68 in the width direction thereof is an upper engagement portion 121 that engages with the relevant lower engagement portion 65 of the lower frame 51. The upper engagement portion 121 is of substantially "L" shape. As shown in FIG. 2, the upper engagement portion 121 is integrally formed with a vertical portion 122 that extends downwardly along the front plate 70 and a protrusion 123 that extends rearward and in a downward slanting direction from a lower edge of the vertical portion 122.

As shown in FIG. 3, a screw attaching portion 67 that is placed over the screw fixing portion formed on the lower frame 51 is provided at each rear end of the upper plate 68 in the width direction thereof.

To secure the upper frame 52 with the lower frame 51, the upper frame 51 contacts with the lower frame 51 at the front side thereof. More specifically an upper surface of the protrusion 123 of the upper engagement portion 121 of the upper frame 52, contacts with a lower surface (cornered surface) of the protrusion 66 of the lower engagement portion 65 of the lower frame 51. The upper frame 52 is rotated about the contact portion of the protrusions 66, 123 as a pivot, so as to place the screw attaching portions 67 over the screw fixing portions formed on the lower frame 51. The upper frame 52 is screwed onto the upper frame 51.

With the upper frame 52 secured with the lower frame 51, the upper surface of the protrusion 123 of the upper engagement portion 121 of the upper frame 52 contacts non-parallel with the lower surface of the protrusion 66 of the lower engagement portion 65 of the lower frame 51. That is, the cornered portion of the protrusion 66 of the lower engagement portion 65 and the upper surface of the protrusion 123 of the upper engagement portion 121 contact in a slanting manner.

With the upper frame 52 set relative to the lower frame 51, a rear wall of the lower frame 51 and the rear plate 69 of the upper frame 52 forms an overlapped portion 124 where the rear wall of the lower frame 51 and the rear plate 69 of the upper frame 52 overlap in the frontward and rearward direction.

In the photosensitive member cartridge 32, the surface of the photosensitive drum 47 is uniformly and positively charged by the scorotron charger 48 while the photosensitive drum 47 rotates. As the surface of the photosensitive drum 47 is selectively exposed to the laser beam emitted from the scanner unit 20 based on image data, an electrostatic latent image is formed on the surface of the photosensitive drum 47.

Thereafter, as the toner, which is carried on the developing roller 37 and is positively charged, is brought into confrontation with the photosensitive drum 47 in accordance with the rotation of the developing roller 37, the toner is supplied to parts of the photosensitive drum 47 selectively exposed to the laser beam where the potential level is lower than the remaining part of the photosensitive drum 47 surface uniformly positively charged. Thus, the toner is selectively carried on the photosensitive drum 47, making the toner image visible.

While the photosensitive drum 47 is rotated, the sheet 3 fed by the register rollers 11 makes contact with the surface of the photosensitive drum 47. The toner carried on the surface of the photosensitive drum 47 is transferred on the sheet 3 when the sheet 3 passes between the photosensitive drum 47 and the transfer roller 49. The sheet 3 having the toner transferred thereon is fed to the fixing unit 22.

As shown in FIG. 2, the cleaning unit 50 is disposed on the rear end portion of the lower frame 51 to face the photosensitive drum 47. The cleaning unit 50 includes a lower unit frame 102, an upper unit frame 103, first and second cleaning rollers 104, 105, as a foreign material removing member and a cleaning member, and a sponge scraper 106, as a foreign material removing member and a scraping member. Disposed on a rear end portion of the lower frame 51 is a cleaning holder plate 108. The lower unit frame 102 is supported above the cleaning holder plate 108.

Figure 10:
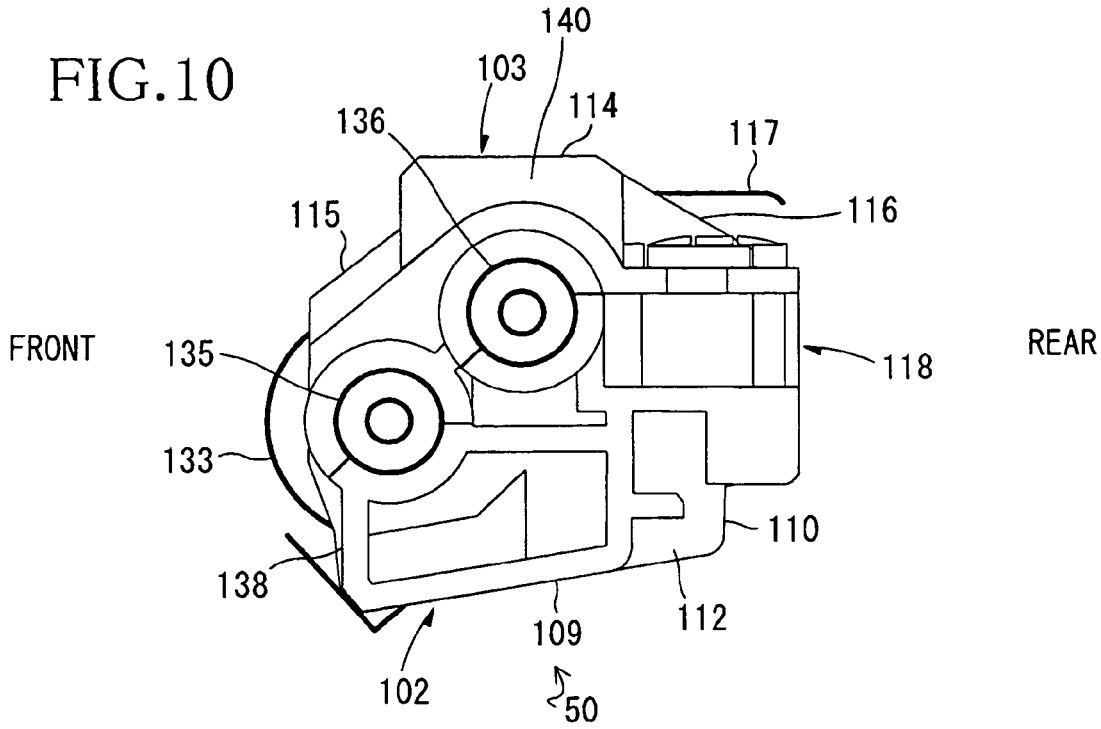
FIG. 10 is a right side view of the cleaning unit shown in FIG. 9.
Figure 11:
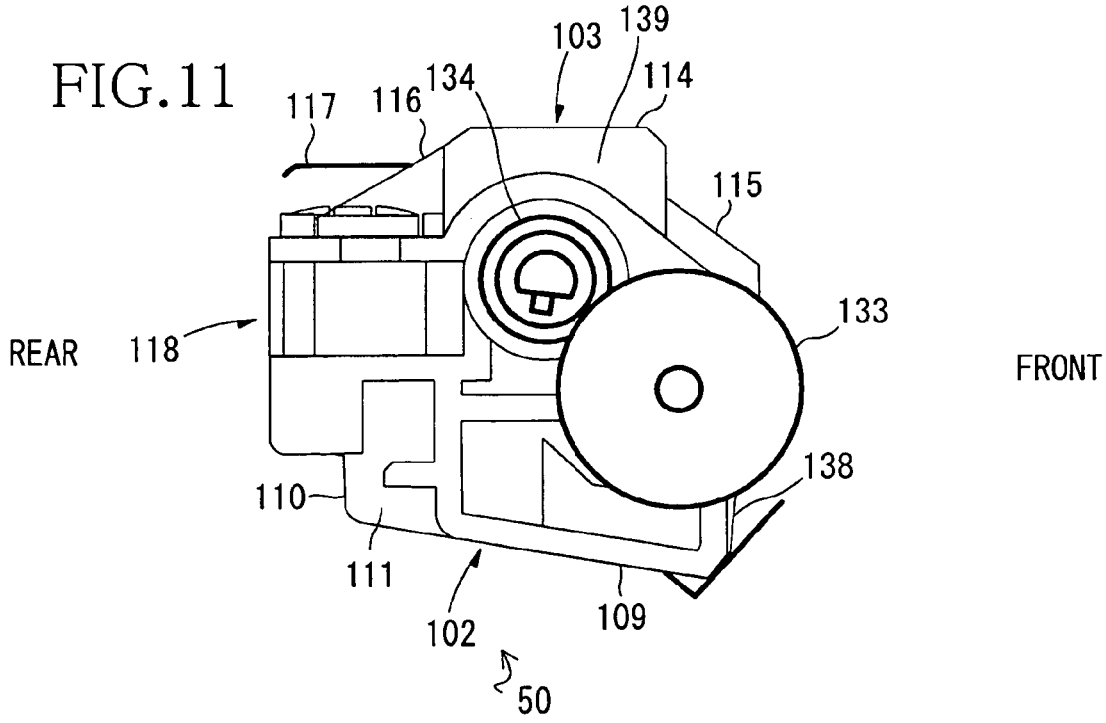
FIG. 11 is a left side view of the cleaning unit shown in FIG. 9.

The lower frame 102 is integrally provided with a bottom wall 109, a rear wall 110, and side walls 111, 112, as shown in FIGS. 10 and 11. A partition wall 113 is provided at a position in the frontward and rearward direction to extend along the width direction perpendicular to the frontward and rearward direction. A front end wall 138 that protrudes upward is disposed on a front end side of the bottom plate 109 to extend in the width direction.

The upper unit frame 103 is integrally provided with an upper wall 114, front and rear inclined walls 115, 116 that incline downwardly from front and rear of the upper wall 114, respectively, and side walls 139, 140, as shown in FIGS. 10 and 11.

Figure 8:
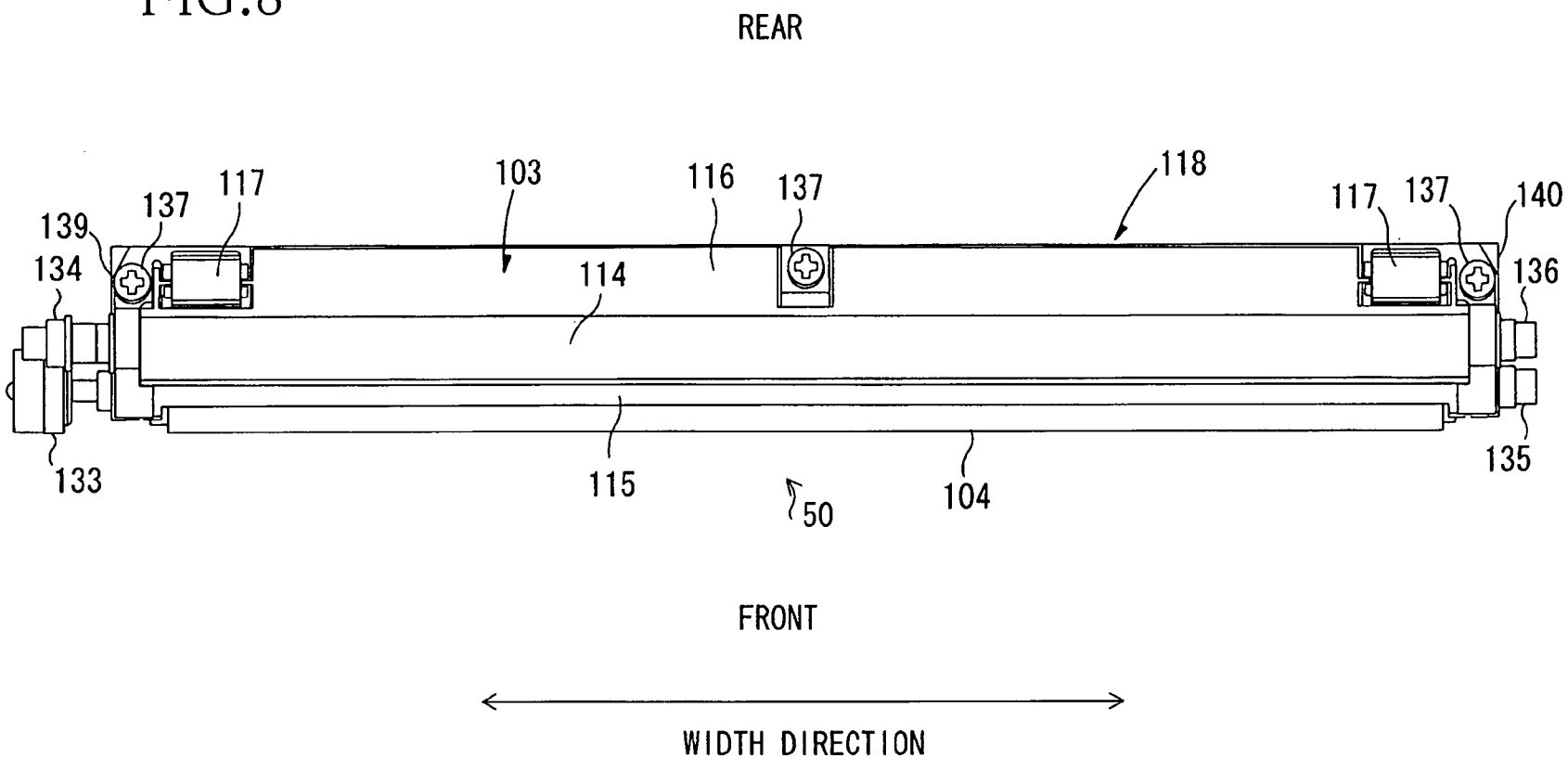
FIG. 8 is a plan view of a cleaning unit of the photosensitive member cartridge shown in FIG. 2.

As shown in FIG. 8, a spring 117, as an urging member, is disposed on each end portion of the rear inclined wall 116 in the width direction thereof. Each spring 117 is formed of a flat spring, as shown in FIGS. 10 and 11. The springs 117 are disposed to urge the first cleaning roller 104 of the cleaning unit 50 toward the photosensitive drum 47, as shown in FIG. 2.

The upper unit frame 103 is disposed above the lower unit frame 102 to cover the lower unit frame 102. As shown in FIG. 8, the upper unit frame 103 is fixed onto the lower unit frame 102, using screws 137. The lower unit frame 102 and the upper unit frame 103 form a case 118 of the cleaning unit 50 that is open at the front side facing the photosensitive drum 47. In the thus formed case 118, the springs 117 are disposed between the upper frame 52 and the upper unit frame 103 and on an opposite side of the photosensitive drum 47 with respect to a facing position where the case 118 faces the photosensitive drum 47, as shown in FIG. 2.

In the case 118, a front side of the partition wall 113 is defined as a paper powder removing chamber 119, as a foreign material removing chamber, and a rear side of the partition wall 113 is defined as a paper powder reservoir 120 as a foreign material reservoir.

Figure 9:
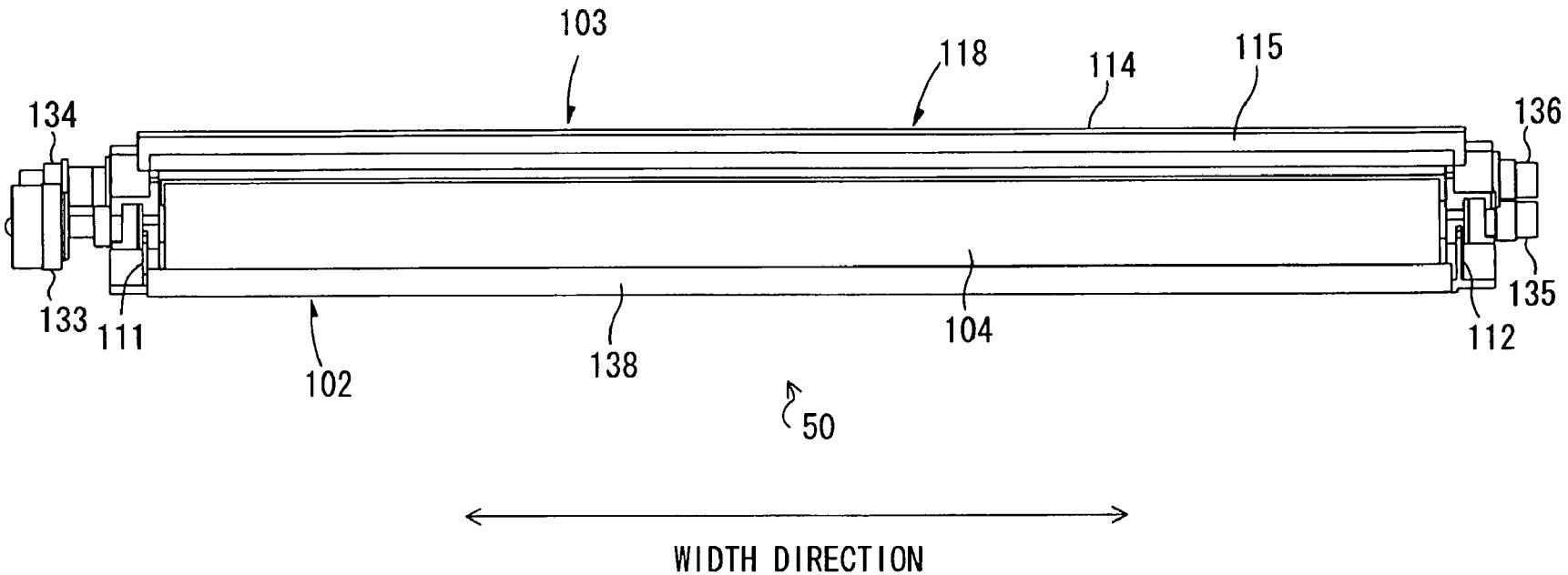
FIG. 9 is a front view of the cleaning unit shown in FIG. 8.

As shown in FIGS. 2 and 9, in the paper powder removing chamber 119, the first cleaning roller 104 is rotatably supported in the side walls 111, 112 of the lower unit frame 102, such that a part of the first cleaning roller 104 is exposed from an opening of the case 118 to contact the photosensitive drum 47. A first cleaning roller drive gear 133 to which drive force from a motor (not shown) is input, is mounted on an end of the first cleaning roller 104 that protrudes outwardly from the side wall 111 in the width direction of the cleaning unit 50, as shown in FIG. 9. The first cleaning roller 104 is rotated by the drive force input to the first cleaning roller drive gear 133. A collar member 135 that functions as an electrode for applying a first cleaning bias to the first cleaning roller 104 is mounted on the other end of the first cleaning roller 104 that protrudes in the width direction of the cleaning unit 50 outwardly from the side wall 112. The first cleaning bias is applied by a power source (not shown) to the first cleaning roller 104 through the collar member 135.

In the paper powder removing chamber 119, the second cleaning roller 105 is rotatably supported in the side walls 111, 112 of the lower unit frame 102, such that the second cleaning roller 105 is disposed behind the first cleaning roller 104 to contact the first cleaning roller 104. A second cleaning roller drive gear 134 that engages with the first cleaning roller drive gear 133 is mounted on an end of the second cleaning roller 105 that protrudes in the width direction of the cleaning unit 50 outwardly from the side wall 111. The second cleaning roller 105 is rotated by the drive force input to the second cleaning roller drive gear 134. A collar member 136 that functions as an electrode for applying a second cleaning bias to the second cleaning roller 105 is mounted on the other end of the second cleaning roller 105 that protrudes in the width direction of the cleaning unit 50 outwardly from the side wall 112. The second cleaning bias is applied by a power source (not shown) to the second cleaning roller 105 through the collar member 136.

In the paper powder removing chamber 119, the sponge scraper 106 is disposed above the second cleaning roller 105 to contact the second cleaning roller 105. The sponge scraper 106 is supported on the upper wall 114 of the upper unit frame 103.

The toner which remains on the photosensitive drum 47, without being transferred on the sheet 3, is collected by the cleaning unit 50. More specifically, in the cleaning unit 50, a bias (negative bias) lower than the potential of the photosensitive drum 47 surface is applied to the first cleaning roller 104 when opposing the portion of the photosensitive drum 47 carrying the toner that was to be transferred onto the sheet 3 but remains on the photosensitive drum 47, to temporarily catch the toner remaining on the photosensitive drum 47.

A bias (positive bias) higher than the potential of the photosensitive drum 47 surface is applied to the first cleaning roller 104 when opposing the portion of the photosensitive drum 47 that does not carry the toner for transfer onto the sheet 3, that is, when a part of the photosensitive drum 47 corresponding to an interval between two successive sheets 3 contacts the first cleaning roller 104, in order to return the toner temporarily caught by the first cleaning roller 104 to the photosensitive drum 47. Paper powders attached by the sheet 3 to the photosensitive drum 47 when the toner is transferred on the sheet 3 are caught by the first cleaning roller 104. The toner returned to the photosensitive drum 47 is collected by the developing roller 37.

The paper powders caught by the first cleaning roller 104 are then electrically caught by the second cleaning roller 105 when the first cleaning roller 104 is brought into confrontation with the second cleaning roller 105. The paper powders caught by the second cleaning roller 105 are scraped by the sponge scraper 106, when opposing the sponge scraper 106, and stored in the paper powder reservoir 120.

More specifically, in the cleaning unit 50, the residual toner and the paper powders on the photosensitive drum 47 are electrically attracted to the first cleaning roller 104. The toner attracted to the first cleaning roller 104 is electrically returned to the photosensitive drum 47. The paper powders attracted to the first cleaning roller 104 is electrically attracted to the second cleaning roller 105 and caught by the second cleaning roller 105. Thus, the paper powders are effectively removed concurrently with the residual toner collection in a cleaner-less system.

As shown in FIG. 1, the fixing unit 22 is positioned downstream of the process unit 21 in the sheet feeding direction behind the process unit 21. The fixing unit 22 includes a heat roller 125, a pressure roller 126 and feed rollers 127. The heat roller 125 includes a metal tube accommodating a halogen lamp as a heat source. The pressure roller 126 is disposed below the heat roller 125 to press the heat roller 125 from below. The feed rollers 127 are disposed downstream of the heat roller 125 and the pressure roller 126 in the sheet feeding direction.

The toner transferred onto the sheet 3 is thermally fixed to the sheet 3 while the sheet 3 passes through between the heat roller 125 and the pressure roller 126. The sheet 3 is guided by the feed rollers 127 to a guide plate 128 vertically disposed behind the feed rollers 125. Then, the sheet 3 is fed toward discharge rollers 129. The sheet 3 fed to the discharge rollers 129 is discharged onto a discharge tray 130.

In the photosensitive member cartridge 32 of the laser printer 1, the wire 71 is vertically and horizontally positioned by the first positioning member 76 and the second positioning member 77, respectively, at the first fixing portion 72. The positioning accuracy required for each first and second positioning member 76, 77 is only the accuracy in a vertical direction and a horizontal direction, respectively. Therefore, as compared with a case where the wire 71 is positioned by a single positioning member, the positioning accuracy required for each positioning member 76, 77 may be reduced. Accordingly, the first and second positioning members 76, 77 are formed with a simple structure and with sufficient strength. In the photosensitive member cartridge 32, the first positioning member 76 positions the wire 71 in the vertical direction. The second positioning member 77 positions the wire 71 in the horizontal direction. Thus, easier and more reliable positioning of the wire 71 is achieved than the positioning of the wire 71 using a single positioning plate. The wire 71 is positioned by the first positioning member 76 and the second positioning member 77 that are disposed with a predetermined distance therebetween in the longitudinal direction of the wire 71. Therefore, the positioning accuracy of the wire 71 is improved.

In the photosensitive member cartridge 32, the wire 71 is disposed with a predetermined distance between the wire 71 and the photosensitive drum 47, so that the photosensitive drum 47 is uniformly charged.

In the first fixing portion 72, the wire 71 is first positioned in the vertical direction by the first positioning member 76 and then in the horizontal direction by the second positioning member 77 disposed outward of the first positioning member 76 in the longitudinal direction of the wire 71. Thus, the positioning of the wire 71 with the first positioning member 76 in the vertical direction in which the scorotron charger 48 and the photosensitive drum 47 face each other, takes precedence over the positioning of the wire 71 in the horizontal direction. Accordingly, the photosensitive drum 47 is uniformly charged by the scorotron charger 48.

In the supporting member 78 of the first fixing portion 72, the wire 71 is supported under tension at a position below the first contact position where the wire 71 contacts the first contact surface 85 (i.e., the wire 71 is pulled toward the first contact portion 79) and on a rear side of the second contact position where the wire 71 contacts the second contact surface 83 (i.e., the wire 71 is pulled toward the second contact surface 83). Thus, the wire 71 is properly positioned by the first and second positioning members 76, 77, and supported by the supporting member 78 while the wire 71 is positioned in the longitudinal direction thereof.

In the first fixing portion 72, while the one end of the wire 71 contacts with the first guide surface 81 of the first positioning member 76, the wire 71 is guided toward a lower slanting direction, to the first contact surface 85, through the restriction surface 82. Thus, the wire 71 is vertically positioned. Then, the one end of the wire 71 placed outwardly in the width direction of the upper plate 52 from the position where the wire 71 is positioned by the first positioning member 76. The one end of the wire 71 contacts with the second guide surface 84 of the second positioning member 77. While contacting with the second guide surface 84, the wire 71 is guided downward and then pulled rearward to contact the second contact surface 83. Thus, the wire 71 is positioned in the horizontal direction.

In the second fixing portion 73, the deepest portion of the slit 96 is at substantially the same level as the height of the first contact surface 85 of the first positioning member 76. Therefore, the other end of the wire 71 and the one end of the wire 71 positioned by the first positioning member 76 are positioned substantially at the same level or height. Thus, the accuracy of positioning the wire 71 over the length of the wire 71 is improved.

In the photosensitive member cartridge 32, the photosensitive drum 47 is supported in the lower frame 51. The scorotron charger 48 is supported in the upper frame 52. With the lower and upper frames 51, 52 assembled together, the scorotron charger 48 is positioned relative to the photosensitive drum 47.

In the photosensitive member cartridge 32 of the laser printer 1, each spring 117 urges the first cleaning roller 104 of the cleaning unit 50 toward the photosensitive drum 47. Therefore, regardless of the mounting accuracy of the cleaning unit 50, the first cleaning roller 104 uniformly contacts the photosensitive drum 47. Even if the position of the cleaning unit 50 relative to the photosensitive drum 47 is deviated every time the cleaning unit 50 is set in the photosensitive member cartridge 32, performances of removing the paper powders is stable. The cleaning unit 50 is urged toward the photosensitive drum 47 with a simple structure using the springs 117.

Each spring 117 urges the cleaning unit 50 toward the photosensitive drum 47 from each end in the width direction of the rear inclined wall 116, that is, each end of the cleaning unit 50 in the axial direction of the photosensitive drum 47. Thus, the first cleaning roller 104 uniformly contacts the photosensitive drum 47 along the longitudinal direction of the photosensitive drum 47.

The springs 117 are disposed on the rear inclined wall 116 of the upper unit frame 103. Due to the inclination of the wall 116, the urging forces of the springs 117 are directed toward the photosensitive drum 47. Thus, the springs 117 reliably urge the cleaning unit 50 and the first cleaning roller 104 is reliably urged toward the photosensitive drum 47.

Each spring 117 urges the cleaning unit 50 that faces the photosensitive drum 47 from the opposite side of the photosensitive drum 47 with respect to a position where the cleaning unit 50 faces the photosensitive drum 47. Accordingly, the reliable contact of the first cleaning roller 104 to the photosensitive drum 47 is made.

Each spring 117 is disposed between the upper frame 52 and the cleaning unit 50, so that the first cleaning roller 104 is reliably urged toward the photosensitive drum 47.

The cleaning unit 50 is supported by the cleaning holder plate 108 of the lower frame 51. The cleaning unit 50, which is disposed in the lower frame 51, is urged by each spring 117 disposed between the upper frame 52 and the cleaning unit 50. Accordingly, the first cleaning roller 104 reliably makes contact with the photosensitive drum 47.

In the cleaning unit 50, paper powders on the photosensitive drum 47 are removed by the first cleaning roller 104. Thereafter, the paper powders caught by the first cleaning roller 104 are caught by the second cleaning roller 105. The paper powders caught by the second cleaning roller 105 are then removed by the sponge scraper 106. As the paper powders caught by the first and second cleaning rollers 104, 105 are removed by the sponge scraper 106, the paper powders are not left in either the first or second cleaning roller 104, 105. Thus, the paper powder removal efficiency may be maintained for a long period of time.

In the cleaning unit 50, the first and second cleaning rollers 104, 105 are disposed in the lower unit frame 102, and the sponge scraper 106 is disposed in the upper unit frame 103. By fixing the upper unit frame 103 onto the lower unit frame 102, the sponge scraper 106 is positioned relative to the first and second cleaning rollers 104, 105. Thus, the cleaning unit 50 is readily and reliably assembled.

In the cleaning unit 50, the paper powder removing chamber 119 and the paper powder reservoir 120 are separated from each other in the case 118. The paper powders removed in the paper powder removing chamber 119 are stored in the paper powder reservoir 120. With the structure, paper powders are prevented from being released or scattered, as well as being attached again to the first or second cleaning roller 104, 105. Accordingly, the paper removing efficiency is improved.

The cleaning unit 50 is open on a side of the paper powder removing chamber 119 facing the photosensitive drum 47. The first cleaning roller 104 is exposed from the opening through which the first cleaning roller 104 contacts the photosensitive drum 47. Therefore, the paper powders on the photosensitive drum 47 are reliably removed.

Although the embodiment is described in detail, those skilled in the art will recognize that there are many possible modifications and variations which may be made in the embodiment.

For example, a charger frame, a photosensitive member cartridge including the charger frame, and an image forming apparatus including the photosensitive member cartridge according to the invention may be applied to various types of image forming apparatuses.

What is claimed is:

1. A charger, comprising:

a wire that generates a corona discharge;

a charger frame that supports the wire; and a first fixing portion that secures at least one end of the wire in a longitudinal direction of the wire, the first fixing portion being disposed in the frame, wherein the first fixing portion includes:

a first positioning member that positions the wire in a first direction perpendicular to the longitudinal direction of the wire; and a second positioning member that positions the wire in the longitudinal direction of the wire and in a second direction perpendicular to the first direction.

2. The charger according to claim 1, wherein the first positioning member and the second positioning member are disposed with a predetermined distance therebetween in a direction parallel to the longitudinal direction of the wire.

3. The charger according to claim 2, wherein the first fixing portion further includes:

a supporting member that supports the at least one end of the wire at a position toward a side of the first positioning member with respect to a first contact position where the wire contacts the first positioning member and toward a side of the second positioning member with respect to a second contact position where the wire contacts the second positioning member.

4. The charger according to claim 3, wherein the supporting member supports the at least one end of the wire at a different height as a height of the wire positioned in the first direction by the first positioning member.

5. The charger according to claim 1, wherein the first positioning member includes a first contact portion that contacts the wire, and a first guide portion that guides the wire to the first contact portion, the wire being positioned at the first contact portion.

6. The charger according to claim 1, wherein the second positioning member includes a second contact portion that contacts the wire, and a second guide portion that guides the wire to the second contact portion, the wire being positioned at the second contact portion.

7. The charger according to claim 1, further comprising a second fixing portion that fixes an other end of the wire in the longitudinal direction of the wire, wherein the second fixing portion fixes the other end of the wire at a substantially same height as a height of the wire positioned at the first fixing portion in the first direction by the first positioning member.

8. The charger according to claim 1, wherein the first direction is a vertical direction and the second direction is a horizontal direction.

9. A photosensitive member cartridge, comprising:

a charger that includes a wire that generates a corona discharge;

a photosensitive member;

a frame that supports the charger and the photosensitive member; and a first fixing portion that secures at least one end of the wire in a longitudinal direction of the wire, the first fixing portion being disposed in the frame, wherein the first fixing portion includes:

a first positioning member that positions the wire in a first direction perpendicular to the longitudinal direction of the wire; and a second positioning member that positions the wire in the longitudinal direction of the wire and in a second direction perpendicular to the first direction.

10. The photosensitive member cartridge according to claim 9, wherein the wire is disposed with a predetermined distance between the wire and the photosensitive member.

11. The photosensitive member cartridge according to claim 9, wherein the frame includes a lower frame that supports the photosensitive member and an upper frame that supports the charger.

12. The photosensitive member cartridge according to claim 9, wherein the first positioning member and the second positioning member are disposed with a predetermined distance therebetween in a direction parallel to the longitudinal direction of the wire.

13. The photosensitive member cartridge according to claim 10, wherein a direction that the charger and the photosensitive member face each other is the first direction.

14. The photosensitive member cartridge according to claim 13, wherein the second positioning member is positioned closer to the at least one end of the wire in the longitudinal direction thereof than the first positioning member.

15. The photosensitive member cartridge according to claim 9, wherein the first fixing portion further includes:

a supporting member that supports the at least one end of the wire at a position toward a side of the first positioning member with respect to a first contact position where the wire contacts the first positioning member and toward a side of the second positioning member with respect to a second contact position where the wire contacts the second positioning member.

16. The photosensitive member cartridge according to claim 15, wherein the supporting member supports the at least one end of the wire at a different height as a height of the wire positioned in the first direction by the first positioning member.

17. The photosensitive member cartridge according to claim 9, wherein the first positioning member includes a first contact portion that contacts the wire, and a first guide portion that guides the wire to the first contact portion, the wire being positioned at the first contact portion.

18. The photosensitive member cartridge according to claim 9, wherein the second positioning member includes a second contact portion that contacts the wire, and a second guide portion that guides the wire to the second contact portion, the wire being positioned at the second contact portion.

19. The photosensitive member cartridge according to claim 9, further comprising:

a second fixing portion that fixes an other end of the wire in the longitudinal direction of the wire, wherein the second fixing portion fixes the other end of the wire at a substantially same height as a height of the wire positioned at the first fixing portion in the first direction by the first positioning member.

20. The photosensitive member cartridge according to claim 9, wherein the first direction is a vertical direction and the second direction is a horizontal direction.

21. An image forming apparatus, comprising:

a photosensitive member cartridge that is removably set in the image forming apparatus, wherein the photosensitive member cartridge includes:

a charger that includes a wire that generates a corona discharge;

a photosensitive member;

a frame that supports the charger and the photosensitive member; and a first fixing portion that secures at least one end of the wire in a longitudinal direction of the wire, the first fixing portion being disposed in the frame, wherein the first fixing portion includes:

a first positioning member that positions the wire in a first direction perpendicular to the longitudinal direction of the wire; and a second positioning member that positions the wire in the longitudinal direction of the wire and in a second direction perpendicular to the first direction.

22. The image forming apparatus according to claim 21, wherein the wire is disposed with a predetermined distance between the wire and the photosensitive member.

23. The image forming apparatus according to claim 21, wherein the frame includes a lower frame that supports the photosensitive member and an upper frame that supports the charger.

24. The image forming apparatus according to claim 21, wherein the first positioning member and the second positioning member are disposed with a predetermined distance therebetween in a direction parallel to the longitudinal direction of the wire.

25. The image forming apparatus according to claim 22, wherein a direction that the charger and the photosensitive member face each other is the first direction.

26. The image forming apparatus according to claim 25, wherein the second positioning member is positioned closer to the at least one end of the wire in the longitudinal direction thereof than the first positioning member.

27. The image forming apparatus according to claim 21, wherein the first fixing portion further includes:

a supporting member that supports the at least one end of the wire at a position toward a side of the first positioning member with respect to a first contact position where the wire contacts the first positioning member and toward a side of the second positioning member with respect to a second contact position where the wire contacts the second positioning member.

28. The image forming apparatus according to claim 27, wherein the supporting member supports the at least one end of the wire at a different height as a height of the wire positioned in the first direction by the first positioning member.

29. The image forming apparatus according to claim 21, wherein the first positioning member includes a first contact portion that contacts the wire, and a first guide portion that guides the wire to the first contact portion, the wire being positioned at the first contact portion.

30. The image forming apparatus according to claim 21, wherein the second positioning member includes a second contact portion that contacts the wire, and a second guide portion that guides the wire to the second contact portion, the wire being positioned at the second contact portion.

31. The image forming apparatus according to claim 21, further comprising:

a second fixing portion that fixes an other end of the wire in the longitudinal direction of the wire, wherein the second fixing portion fixes the other end of the wire at a substantially same height as a height of the wire positioned at the first fixing portion in the first direction by the first positioning member.

32. The image forming apparatus according to claim 21, wherein the first direction is a vertical direction and the second direction is a horizontal direction.

* * * * *